US007887383B1

(12) United States Patent
Pott

(10) Patent No.: US 7,887,383 B1
(45) Date of Patent: Feb. 15, 2011

(54) BUYOANT INFANT SAFETY SEAT

(76) Inventor: Jason David Pott, 2013 Red Bud Rd. NE., Calhoun, GA (US) 30701

( * ) Notice: Subject to any disclaimer, the term of this patent is extended or adjusted under 35 U.S.C. 154(b) by 0 days.

(21) Appl. No.: 12/506,103

(22) Filed: Jul. 20, 2009

(51) Int. Cl.
*B63C 9/30* (2006.01)

(52) U.S. Cl. ..... 441/126; 441/130

(58) Field of Classification Search ..... 441/126, 441/130
See application file for complete search history.

(56) References Cited

U.S. PATENT DOCUMENTS 4,798,551 A * 1/1989 Dumonceaux et al. ..... 441/130
6,056,346 A * 5/2000 Smuk ..... 296/65.03
6,412,865 B1 * 7/2002 Bedard ..... 297/250.1
2005/0200175 A1 * 9/2005 Charles et al. ..... 297/238

* cited by examiner

*Primary Examiner*—Stephen Avila
(74) *Attorney, Agent, or Firm*—Quick Patents, Inc.; Kevin Prince

(57) ABSTRACT

A safety seat for a child for use proximate a body of water is disclosed. The safety seat may be fixed with a vehicle, such as a boat, or used independently on a ground surface. A seat is adapted to hold the child in a seated position therein. A base engagement is fixed with a lower side of the seat and comprises a projection having therein a buoyant material in a top portion thereof. The base engagement further includes a weighted material, such as metal weights or the like, in a bottom portion thereof. A base has an open top end and is adapted to slidably receive the projection of the base engagement. If the base becomes submerged in the body of water, the seat and the base engagement slide out of the base, the weighted material maintaining the seat in an upright orientation above a surface of the water.

12 Claims, 3 Drawing Sheets

BUYOANT INFANT SAFETY SEAT

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to infant seats, and more particularly to an infant safety seat for use is when proximate to water.

DISCUSSION OF RELATED ART

Many people who enjoy boating, pools, lakeside activities and the like do so together with friends or as a family, which often involves small children or infants. Because of the inherent dangers of having an infant proximate a body of water, even if secured in a car seat or stroller, for example, adults often exclude themselves and their infants entirely from boating or poolside activities.

Some people outfit their infants with a Personal Floatation Device (PFD), also known as a life jacket. Particularly for infants, however, such PFDs often do not fit properly due to the speed at which infants grow, and such PFDs have a tendency to keep a person afloat face-down, causing a victim to struggle to stay on their back and keep their head out of water. Unfortunately, a young infant cannot do either one of these on their own. Indeed, it is a struggle for an adult in many cases.

Therefore, there is a need for a device that provides a seating support for an infant on a stable base, the base being rollable on a surface much like a stroller, and also fixable within a water craft or other vehicle, such as a boat. Such a needed device would, if submerged, allow a seat portion to float on the surface of the water, detaching from the base if necessary. Such a detachable seat would keep an infant above the surface of the water, being weighted so as to always prefer an upright orientation when in water. The present invention accomplishes these objectives.

SUMMARY OF THE INVENTION

The present device is a safety seat for a child for use proximate a body of water, such as a lake or pool. The safety seat may be fixed with a vehicle, such as a boat, or used independently on a ground surface. The safety seat helps to protect the child from drowning if the seat is introduced into the body of water.

A seat means is adapted to hold the child in a seated position therein. The seat means includes a plurality of adjustable retention straps that are each secured to at least one closure to retain the child in, preferably, a five-point retention strap arrangement. The seat means is buoyant, being made at least partially from buoyant materials.

A base engagement means is fixed with a lower side of the seat means and comprises a projection having therein a buoyant material in a top portion thereof. The base engagement means further includes a weighted material, such as metal weights or the like, in a bottom portion thereof.

A base has at least one attachment means proximate a bottom side thereof. The seat base has an open top end and is adapted to slidably receive the projection of the base engagement means. A rear side of the base may include at least one wheel rotatable fixed proximate thereto, such that when the base is tilted on a ground surface each wheel contacts the surface to facilitate rolling of the base therealong.

In use, gravity retains the seat means and the base engagement means in the base. The base may be secured to a vehicle, such as the boat, with the at least one attachment means. As such, if the base becomes submerged in the body of water, the seat means and the base engagement means float away from the base, the weighted material maintaining the seat means in an upright orientation above a surface of the water.

The present invention is a device that provides a seating support for an infant on a stable base, the base being rollable on a surface much like a stroller. The present device is also fixable within a vehicle, such as a boat, jet-ski, or the like, and designed for use around pools, docks, lakes, boats, and other marine or water environments. If submerged, the seat means floats on the surface of the water, detaching from the base if necessary. The present device keeps an infant above the surface of the water, being weighted so as to always prefer an upright orientation when in water. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
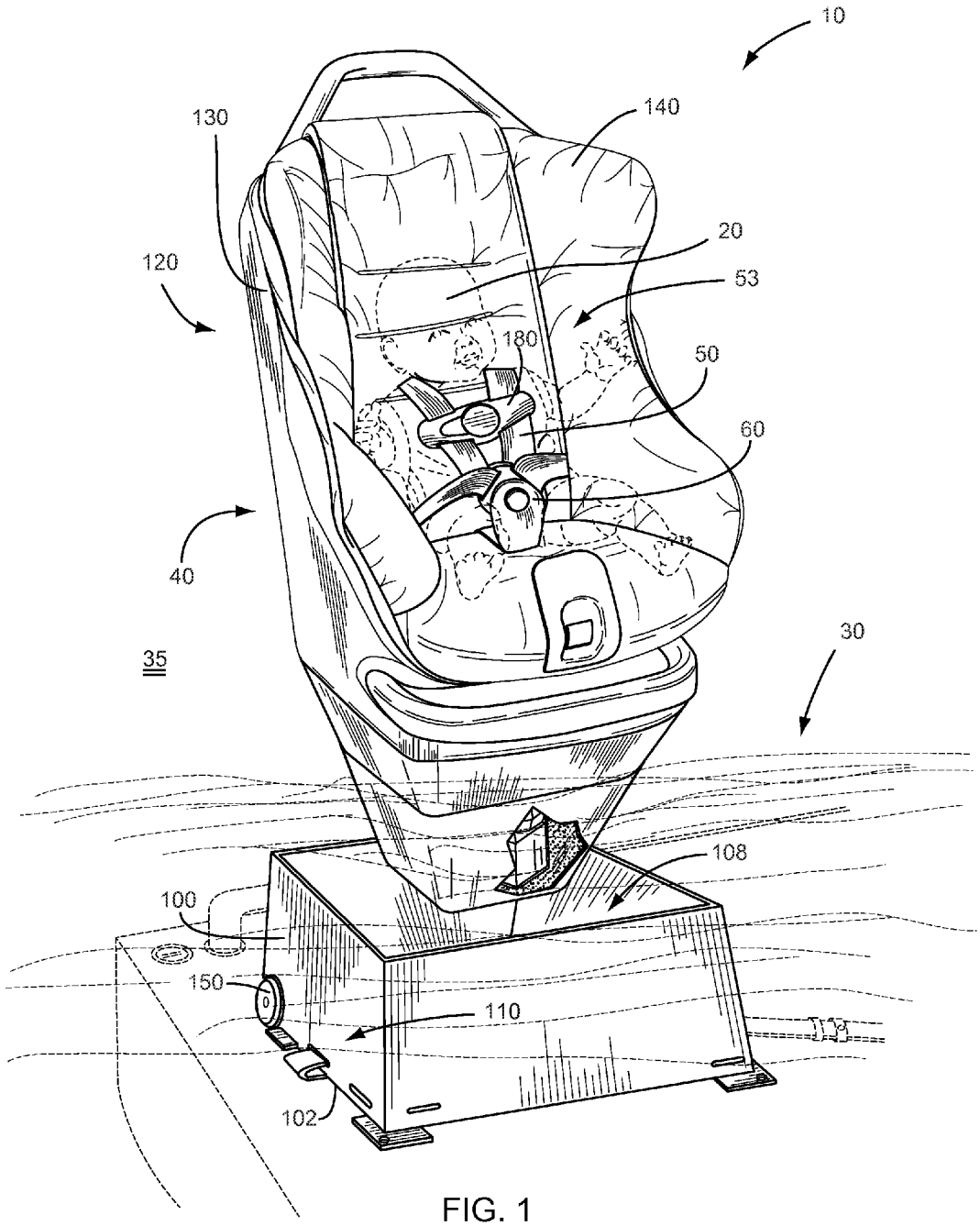
FIG. 1 is a perspective view of the invention, illustrated with a base submerged in a body of water and a seat means floating thereon.
Figure 4:
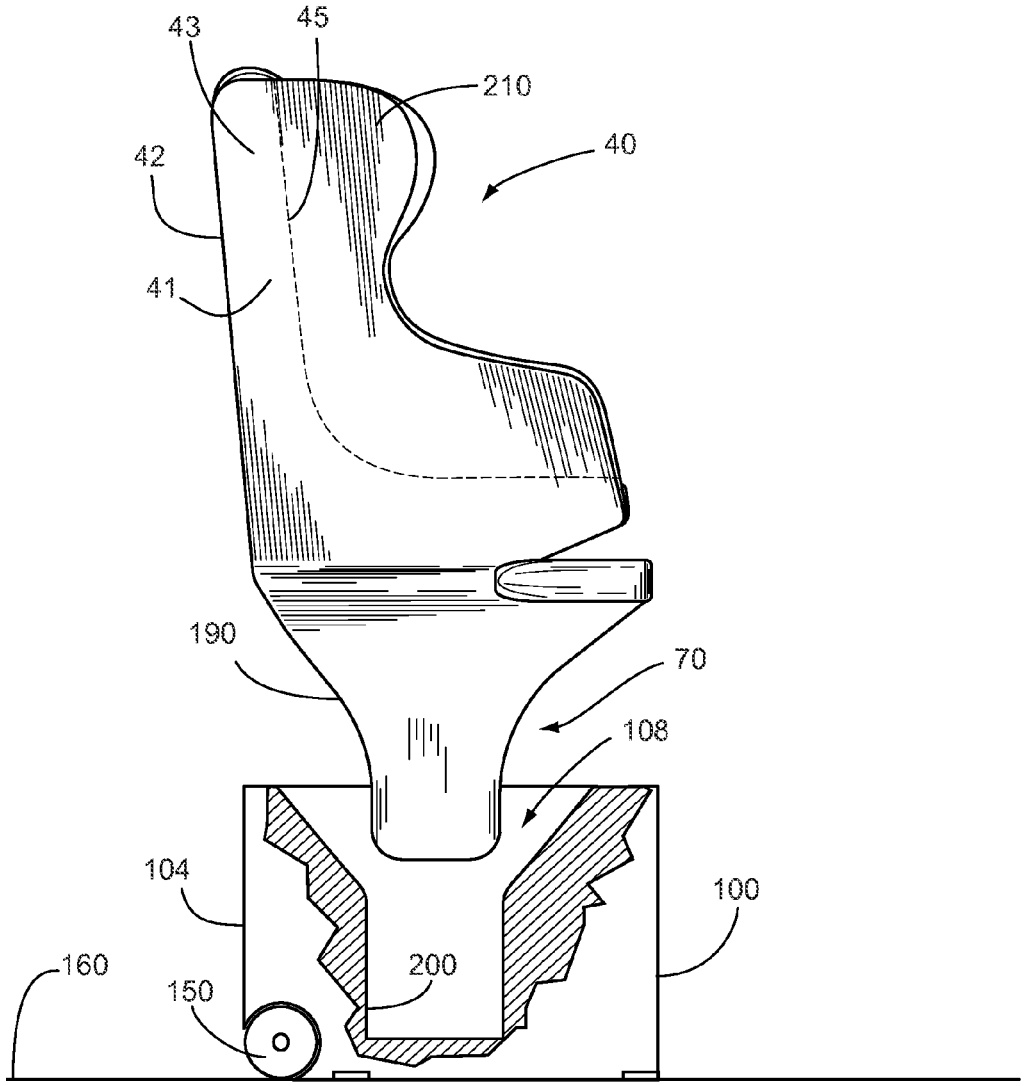
FIG. 4 is an exploded right-side elevational view of the invention, illustrating the seat means and the base engagement means as detached from the base, the base partially cut-away.

FIGS. 1 and 4 illustrate a safety seat 10 for a child 20 for use proximate a body of water 30, such as a lake or pool. The safety seat 10 may be fixed with a vehicle, such as a boat (FIG. 1), or used independently on a ground surface 160 (FIG. 4). The safety seat 10 helps to protect the child from drowning if the seat 10 is introduced into the body of water 30.

Figure 5:
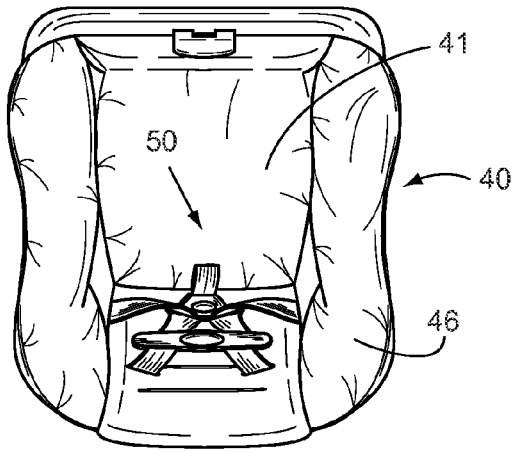
FIG. 5 is a top plan view thereof, illustrating a plurality of adjustable retention straps.

A seat means 40 is adapted to hold the child 20 in a seated position therein. The seat means 40 includes a plurality of adjustable retention straps 50, such as nylon straps or the like, that are each secured to at least one closure 60. The retention straps 50 are selectively mutually fixed with the closure 60 to retain the child 20 in the seat means 40. The plurality of adjustable retention straps 50 may include a pair of shoulder and waist straps 51 (FIGS. 1 and 5) that each include a buckle clip 61 slidably fixed thereto. Further, the retention straps 50 may further include a crotch strap 52 terminating in a buckle closure 62, such that each buckle clip 61 of each shoulder and waist strap 51 may be selectively locked into the buckle closure 62 to retain the child in a five-point retention strap arrangement 53 (FIG. 1). A chest clip 180 may be slidably engaged to each shoulder and waist strap 51 above the buckle clip 61 thereon. The closure 60 may also include mechanical snaps, buckles, hook-and-loop type fasteners, or the like.

The seat means 40 is buoyant, being made at least partially from buoyant materials such as open or closed cell foam materials, buoyant plastic materials, and the like. The seat means 40 may include a non-flexible back member 130, made from plastic for example, having a back side 132 and a front side 138, and further including a plush material seat 140 fixed with the front side 138 of the back member 130. The plush material may include a foam material covered with a cotton or other textile fabric, for example.

A base engagement means 70 is fixed with a lower side 42 of the seat means 40 and comprises a projection 80 having therein a buoyant material 90, such as Styrofoam or the like, in a top portion 78 thereof. The base engagement means 70 further includes a is weighted material 95, such as metal weights or the like, in a bottom portion 72 thereof.

A base 100 has at least one attachment means 110 proximate a bottom side 102 thereof. The seat base 100 has an open top end 108 and is adapted to slidably receive the projection 80 of the base engagement means 70. A rear side 104 of the base 100 may include at least one wheel 150 (FIGS. 1 and 4) rotatable fixed proximate thereto, such that when the base 100 is tilted on a ground surface 160 each wheel 150 contacts the surface 160 to facilitate rolling of the base 100 therealong.

The seat means 40 and the base engagement means 70 may be indexed with respect to the base 100, such that the seat means 40 and the base engagement means 70 may only be engaged with the base 100 in one direction. Such indexing may be accomplished with an asymmetric projection 80 (not shown) and a corresponding asymmetric open top end 108 of the base 100. The base engagement means 170 may also include at least one substantially vertical side 190 (FIG. 4), wherein the base 100 includes at least one cooperative vertical side 200, such that the seat means 40 and the base engagement means 70 may only be removed from the base 100 from substantially a single direction, orthogonal to the bottom side 102 of the base 100. If the base 100 is submerged, the seat means 40 is able to float away from the base 100. Likewise, if the base 100 is forcefully flipped over, such as if a boat in which the safety seat 10 is secured flips, for example, centrifugal force causes the seat means 40 to be ejected in one direction away from the base 100.

In use, gravity retains the seat means 40 and the base engagement means 70 in the base 100. The base 100 may be secured to a vehicle, such as a boat, with the at least one attachment means 110, such as with a seatbelt of the vehicle or the like (FIG. 1). As such, if the base 100 becomes submerged in the body of water 30, the seat means 40 and the base engagement means 70 float away from the base 100, the weighted material 95 maintaining the seat means 40 in an upright orientation 120 above a surface 35 of the water 30. The seat means 40 may further include a bright indicator attached thereto (not shown) for facilitating visual identification thereof if the seat means 40 becomes separated from the base 100.

Figure 3:
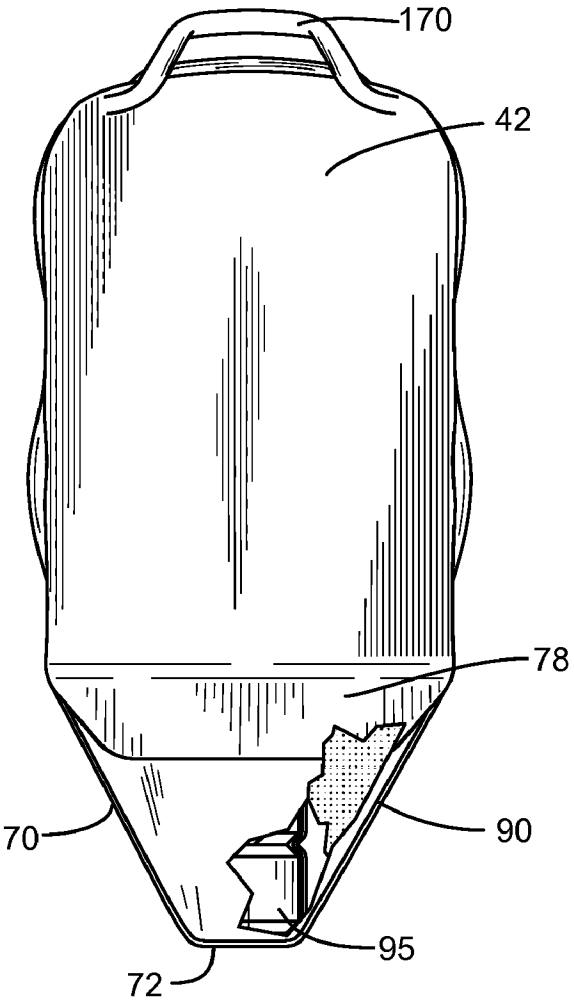
FIG. 3 is a rear elevational view thereof, partially cut-away to reveal a weighted material.
Figure 2:
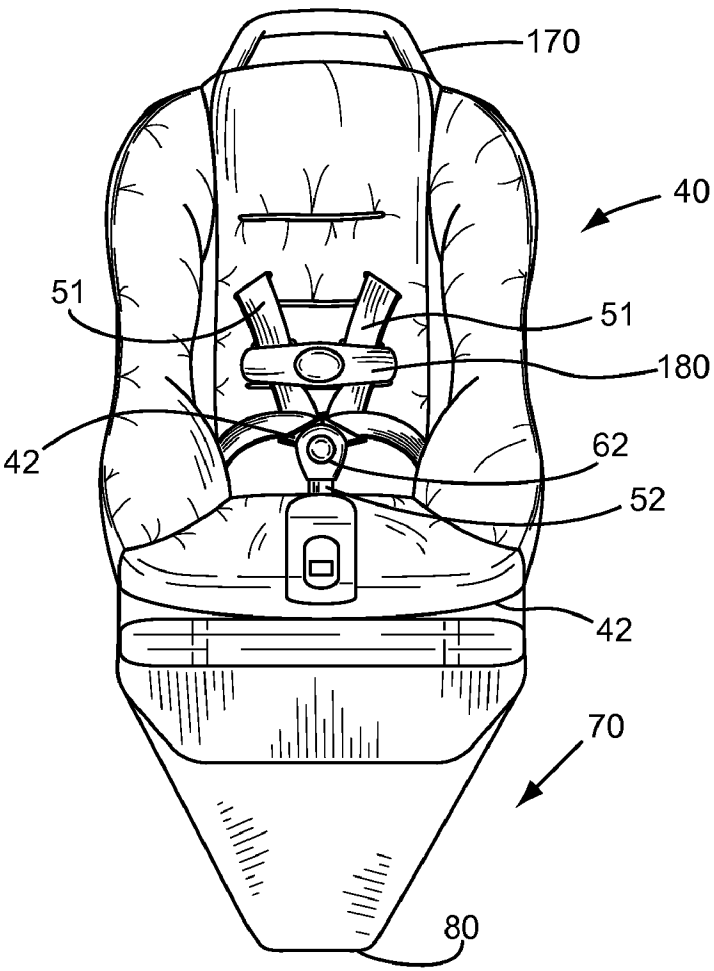
FIG. 2 is a front elevational view of a seat means and a base engagement means of the invention.

In the embodiment having the back member 130 and the at least one wheel 150, an upwardly projecting handle 170 (FIGS. 2 and 3) may be included projecting upwardly from the back member 130. As such, with the seat means 40 and the base engagement means 70 engaged with the base 100, the handle 170 may be urged backward to tilt the safety seat 10 to roll the safety seat along the ground surface 160, or used to pull the seat means 40 out of the body of water 30 if necessary.

Figure 6:
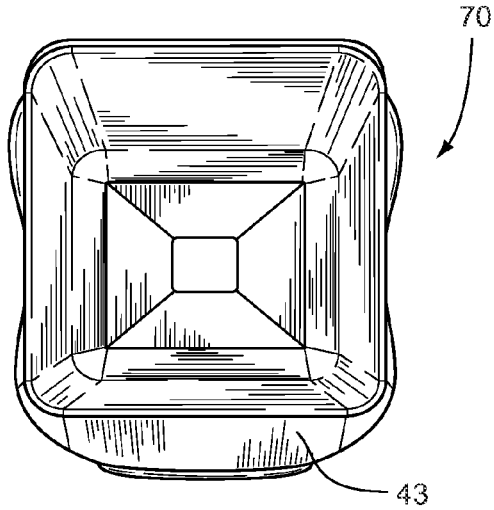
FIG. 6 is a bottom plan view of the base engagement means and the seat means.

In one embodiment of the invention, the seat means 40 takes the form of a seat 41 that includes a non-flexible back member 43 (FIGS. 4 and 6) that has a back side 44, the upwardly projecting handle 170, a front side 45, and a plush material 46 fixed with the front side 45 of the back member 43. The seat 41 may further include a pair of head protectors 210 (FIG. 4) projecting away from the front side 45 of the back member 43 for protecting the side of the child's head when the child 20 is seated therein.

While a particular form of the invention has been illustrated and described, it will be apparent that various modifications can be made without departing from the spirit and scope of the invention. For example, the shape of the projection 80 is depicted in the drawings, but the projection 80 may take any suitable shape, provided it corresponds and cooperates with the shape of the open top end 108 of the base 100. Accordingly, it is not intended that the invention be limited, except as by the appended claims.

The teachings provided herein can be applied to other systems, not necessarily the system described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

These and other changes can be made to the invention in light of the above Detailed Description. While the above description details certain embodiments of the invention and describes the best mode contemplated, no matter how detailed the above appears in text, the invention can be practiced in many ways. Details of the system may vary considerably in its implementation details, while still being encompassed by the invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A safety seat for a child when proximate a body of water, comprising:

a seat means adapted to hold the child in a seated position therein, the seat means including a plurality of adjustable retention straps each secured to at least one closure, the retention straps being selectively mutually fixed with the closure to retain the child in the seat means, the seat means being buoyant and further including a non-flexible back member having a back side and a front side, and further including a plush material seat fixed with the front side of the back member;

a base engagement means fixed with a lower side of the seat means, the base engagement means comprising a projection having therein a buoyant material in a top portion thereof, and a weighted material in a bottom portion thereof;

a base having at least one attachment means proximate a bottom side thereof, the seat base having an open top end and adapted to slidably receive the projection of the base engagement means;

at least one wheel being rotatably fixed proximate a rear side of the base, such that when the base is tilted on a ground surface each wheel contacts the surface to facilitate rolling of the base along the ground surface;

whereby gravity retains the seat means and the base engagement means in the base, and when the base is submerged the seat means and base engagement means float, the weighted material maintaining the seat means in an upright orientation above the surface of the water.

2. The safety seat of claim 1 wherein the back member includes an upwardly projecting handle, whereby with the seat means and the base engagement means engaged with the base, the handle may be urged backward to tilt the safety seat to roll the safety seat along the ground surface.

3. The safety seat of claim 1 wherein the plurality of adjustable retention straps includes a pair of shoulder and waist straps that each include a buckle clip slidably fixed thereto, and further including a crotch strap terminating in a buckle closure, such that each buckle clip of each shoulder and waist strap may be selectively locked into the buckle closure to retain the child in a five-point retention strap arrangement.

4. The safety seat of claim 3 wherein a chest clip is slidably engaged to each shoulder and waist strap above the buckle clip thereon.

5. The safety seat of claim 1 wherein the seat means and base engagement means are indexed with respect to the base, whereby the seat means and base engagement means may only be engaged with the base in one direction.

6. The safety seat of claim 1 wherein the base engagement means includes at least one substantially vertical side, and wherein the base includes at least one cooperative vertical side, such that the seat means and base engagement means may only be removed from the base from substantially a single direction.

7. A safety seat for a child when proximate a body of water, comprising:

a seat adapted to hold the child in a seated position therein, the seat including a non-flexible back member having a back side, an upwardly projecting handle, and a front side, a plush material fixed with the front side of the back member, and a plurality of adjustable retention straps each secured to the back member and at least one closure, the retention straps being selectively mutually fixed with the closure to retain the child in the seat, the seat being buoyant;

a projection fixed with a lower side of the seat and having therein a buoyant material in a top portion thereof, and a weighted material in a bottom portion thereof;

a base having at least one attachment aperture proximate a bottom side thereof, the base having an open top end and adapted to slidably receive the projection therein, the base further including at least one wheel rotatably fixed proximate a rear side thereof;

whereby gravity retains the seat and the projection in the base, such that the handle may be used to tilt the safety seat on a ground surface so that each wheel contacts the surface to facilitate rolling of the safety seat along the ground surface, and whereby when the base is submerged the seat and projection float, the weighted material maintaining the seat in an upright orientation above the surface of the water.

8. The safety seat of claim 7 wherein the plurality of adjustable retention straps includes a pair of shoulder and waist straps that each include a buckle clip slidably fixed thereto, and further including a crotch strap terminating in a buckle closure, such that each buckle clip of each shoulder and waist strap may be selectively locked into the buckle closure to retain the child in a five-point retention strap arrangement.

9. The safety seat of claim 7 wherein a chest clip is slidably engaged to each shoulder and waist strap above the buckle clip thereon.

10. The safety seat of claim 7 wherein the seat and projection are indexed with respect to the base, whereby the seat and projection may only be engaged with the base in one direction.

11. The safety seat of claim 7 wherein the projection includes at least one substantially vertical side, and wherein the base includes at least one cooperative vertical side, such that the seat and projection may only be removed from the base from substantially a single direction.

12. The safety seat of claim 7 wherein the seat further includes a pair of head protectors projecting away from the front side of the back member, whereby the side of the child's head is protected when the child is seated therein.

* * * * *